US005579086A

United States Patent [19]

Ikunami et al.

[11] Patent Number: 5,579,086

[45] Date of Patent: Nov. 26, 1996

[54] IMAGE FORMING APPARATUS WITH REMOVABLE PHOTORECEPTOR CARRIAGE

[75] Inventors: Yoshikazu Ikunami; Kazuyoshi Kimura, both of Hachioji, Japan

[73] Assignee: Konica Corporation, Japan

[21] Appl. No.: 549,401

[22] Filed: Oct. 27, 1995

[30] Foreign Application Priority Data

Nov. 11, 1994 [JP] Japan ..... 6-277978

[51] Int. Cl.[6] ..... G03G 15/00

[52] U.S. Cl. ..... 355/200; 355/210

[58] Field of Search ..... 355/200, 210; 347/138, 152

[56] References Cited

U.S. PATENT DOCUMENTS 4,630,921 12/1986 Watanabe ..... 355/202
4,873,554 10/1989 Greco, Jr. ..... 355/200 X
5,030,988 7/1991 Haneda et al. ..... 355/200
5,486,898 1/1996 Fujii ..... 355/200

FOREIGN PATENT DOCUMENTS 0370455 5/1990 European Pat. Off. .
0411825 2/1991 European Pat. Off. .
0639801 2/1995 European Pat. Off. .

*Primary Examiner*—Arthur T. Grimley
*Assistant Examiner*—Sophia S. Chen
*Attorney, Agent, or Firm*—Jordan B. Bierman; Bierman and Muserlian

[57] ABSTRACT

An image forming apparatus having a carriage which can be pulled out from an installed position thereof. The carriage supports a cartridge including an image forming body, at a pull-out position, and fixes the cartridge to a position at which an image can be formed, at the installed position of the carriage. When the carriage is located at the installed position, the carriage forms at least a part of the upper surface of a main body of the apparatus.

9 Claims, 5 Drawing Sheets

IMAGE FORMING APPARATUS WITH REMOVABLE PHOTORECEPTOR CARRIAGE

BACKGROUND OF THE INVENTION

The present invention relates to an image forming apparatus, in which a charging means, an image exposure means and a developing means are arranged around an image forming body, a toner image is formed on the peripheral surface of the image forming body when the image forming body is rotated, and then, the toner image is transferred onto a recording sheet.

In an image forming apparatus, specifically, in a conventional electrophotographic copier for office use, or an image recording apparatus used for terminal equipment, the following apparatus, for easily carrying out jam clearance operations or maintenance operations, are widely known. There is an apparatus in which a cartridge for incorporating a photoreceptor and developing units therein, is removed when a side door of the apparatus main body is opened, and the surface of the conveyance path for the transfer material is exposed. Further, there is a clamshell type apparatus in which the apparatus main body is separated into an upper and a lower main body, and the surface of the conveyance path for the transfer material is exposed.

However, when the apparatus is structured such that the photoreceptor, developing units, etc., are removed from the apparatus, there is potential danger in which the removed units are touched by the operator's hands or other units and are stained, and specifically, in the case of developing units, there is a possibility in which foreign matter adheres to a developing sleeve, resulting in image degradation.

Further, in a clamshell type apparatus, the conveyance path of the recording sheet is used as a separation line to open and close the upper portion of the apparatus with respect to the lower portion of the apparatus. In this case, normally, it is necessary to separate the photoreceptor from the transfer unit for easier jam clearing. As a result, a portion of the photoreceptor which is opposed to the transfer unit, is largely exposed, and a possibility occurs in which operator's hands easily touch the portion, and the surface of the photoreceptor is stained. Further, in the case of a color image forming apparatus, since a plurality of developing units are incorporated into an upper main body, the weight of the upper main body is increased, and thereby, the ease of operation decreases, and the strength and rigidity of the whole apparatus main body are also decreased. Therefore, when an image is formed, the apparatus is more easily and adversely affected by oscillations, which is a problem.

SUMMARY OF THE INVENTION

The present inventors solved and improved the above-described problems. An object of the present invention is to provide a color image forming apparatus from which a photoreceptor and developing units can be removed without being touched with the operator's hands or other units, and the surface of the conveyance path for the transfer material is opened so that jam clearance or maintenance of the apparatus can be safely and easily carried out.

The above-described object is attained by the following image forming apparatus of the present invention.

The image forming apparatus is provided with a carriage, which can be pulled out from its installed position. The carriage supports a cartridge, including an image forming body, in its pull-out position, and fixes the cartridge at a position, at which an image can be formed, at the installed position of the carriage.

The image forming apparatus is provided with a carriage, which can be pulled out from its installed position. The carriage supports a cartridge, including an image forming body, at its pull-out position, and fixes the cartridge to a position, at which an image can be formed, at the installed position of the carriage. Further, when the carriage is located at its installed position, it forms at least a portion of the upper surface of the apparatus main body.

DETAILED DESCRIPTION OF THE PREFERRED EMBODIMENTS

An example of the present invention will be described according to a color image forming apparatus shown in FIGS. 1 through 5.

Figure 1:
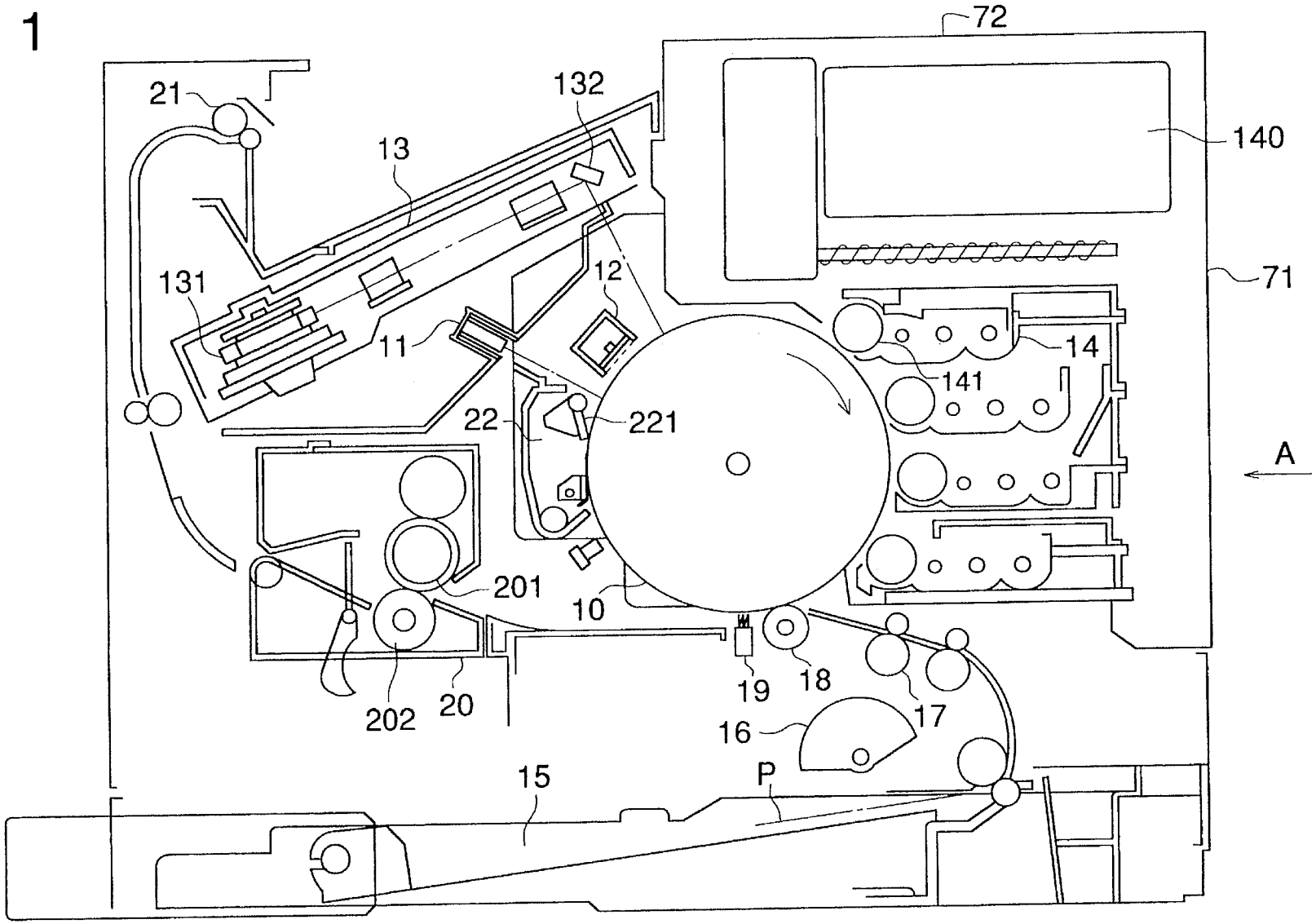
FIG. 1 is a sectional view showing a structure of a color image forming apparatus according to the present invention.

In FIG. 1, numeral 10 is a photoreceptor drum, which is an image forming body, with an OPC photoreceptor coated on the drum. The photoreceptor drum is electrically grounded, and driven clockwise. Numeral 12 is a scorotron charger which uniformly charges the peripheral surface of the photoreceptor drum 10 with a potential voltage of $V_H$ by a corona discharge using a grid, having the potential voltage of $V_G$, and a corona discharge wire. Before being charged by the scorotron charger 12, an exposure by a PCL 11 using a light emitting diode, or the like, is carried out so that the hysteresis of the photoreceptor due to previous printing are eliminated, and the peripheral surface of the photoreceptor is electrically discharged.

After the photoreceptor has been uniformly charged, an image exposure is carried out by an image exposure means 13 according to an image signal. In the image exposure means 13, the optical path of a light beam, emitted from a light source composed of a laser diode, not shown in the drawing, is bent by a reflection mirror 132 after the light beam passes through a rotating polygonal mirror 131, an fθ lens, or the like. Then, scanning is carried out, and a latent image is formed on the photoreceptor by the rotation of the photoreceptor drum 10 (subsidiary scanning). In this example, a character portion is exposed, and a reversal latent image, in which the character portion has a lower potential voltage $V_L$, is formed.

Developing unit 14, in which developers composed of yellow (Y), magenta (M), cyan (C), and black (K) toners, and carrier, are respectively loaded, are provided around the photoreceptor drum 10. Initially, the first color development is conducted by a developing sleeve 141, in which a magnet is housed, and which is rotated while retaining developer thereon. Developer is composed of carrier and toner, wherein the carrier has ferrite core, and an insulation resin is coated around the core. Toner is made of polyester as a main material, and pigments corresponding to colors, charge control agents, silica, titanium oxide, etc., are added to the main material. The developer is regulated to a layer thickness of 100 through 600 μm on the developing sleeve 141 by a layer forming means, and conveyed to a developing area.

A gap 0.2 through 1.0 mm is formed between the developing sleeve 141 and the photoreceptor drum 10 in the developing area, which is larger than the layer thickness of the developer, and an AC bias voltage of $V_{AC}$ and a DC bias voltage of $V_{DC}$ are superimposed on this gap. Since $V_{DC}$, $V_H$, and the electric charge of toner have the same polarity, the toner, which is triggered to separate from the carrier by the $V_{AC}$, does not adhere to the $V_H$ portion, the potential voltage (an absolute value) of which is higher than that of $V_{DC}$, but adheres to the $V_L$ portion, the potential voltage of which is lower than that of $V_{DC}$, and thereby, a latent image is visualized (reverse development).

After the first color visualizing operation, the system enters into the second color image formation process. The peripheral surface of the photoreceptor drum 10 is uniformly charged again by the scorotron charger 12, and a latent image according to the second color image data is formed by the image exposure means 13. In this case, the discharging operation conducted by the PCL 11 in the first color image formation process, is not conducted because the toner, adhered to the first color image portion, scatters due to the sudden decrease of the surrounding potential voltage.

The whole peripheral surface of the photoreceptor drum 10 is uniformly charged again so that the photoreceptor has the potential voltage of $V_H$. On the photoreceptor, the same latent image as in the first color is formed on a portion in which a first color image does not exist, and a latent image is developed. In a portion in which development is carried out again with respect to a portion having the first color image, a latent image having the potential voltage of $V_M'$ is formed by light-shielding due to the adhered first color toner, and electric charges of the toner itself, and development is conducted corresponding to the potential difference between $V_{DC}$ and $V_M'$. In the portion in which the first color image and the second color image are superimposed, when the first color development is conducted after a latent image having the potential voltage of $V_L$ has been formed, the balance between the first color image and the second color image is lost. Accordingly, in some cases, the exposure amount of the first color is decreased, and the intermediate potential voltage $V_M$ having the relationship, $V_H>V_M>V_L$, is used.

In the same way as the second color image formation process, the third and the fourth color image forming processes are carried out, and a four-color visualized image is formed on the peripheral surface of the photoreceptor drum 10.

Recording sheet P, conveyed from a sheet feed cassette through a semi-circular roller 16, temporarily stops, and then, the recording sheet P is conveyed to the transfer area by the rotation of a sheet feed roller 17 in timed relationship with the transfer unit.

In the transfer area, a transfer roller 18 is brought into pressure contact with the peripheral surface of the photoreceptor drum 10 in timed relationship with the transfer, the recording sheet P, fed from the sheet feed cassette 15, is sandwiched between the transfer roller 18 and the peripheral surface of the photoreceptor drum 10, and a multi-color image is simultaneously transferred onto the sheet P.

Next, the recording sheet P is discharged by a peak-electrode 19, having a narrow gap with respect to the surface of the photoreceptor drum 10, and the sheet P is separated from the peripheral surface of the photoreceptor drum 10. The recording sheet P is conveyed to a fixing unit 20, and a toner is fused by the heat of a thermal roller 201 and pressure of a pressure roller 202. Then, the recording sheet P is delivered outside the apparatus with a delivery roller 21. The above-described transfer roller 18 is withdrawn from the peripheral surface of the photoreceptor drum 10 after passage of the recording sheet P, and the transfer roller 18 is ready for the next toner image formation.

Residual toner on the peripheral surface of the photoreceptor drum 10, from which the recording sheet P is separated, is removed from the peripheral surface of the photoreceptor drum 10, and the peripheral surface of the photoreceptor drum 10 is cleaned, when a blade 221 of a cleaning unit 22 is brought into pressure contact with the peripheral surface of the photoreceptor drum 10. The photoreceptor drum 10 is discharged again by the PCL 11 and charged again by the charger 12, and enters into the next image formation process. The above-described blade 221 is immediately withdrawn from the peripheral surface of the photoreceptor drum 10 after cleaning the surface of the photoreceptor drum 10.

Figure 2:
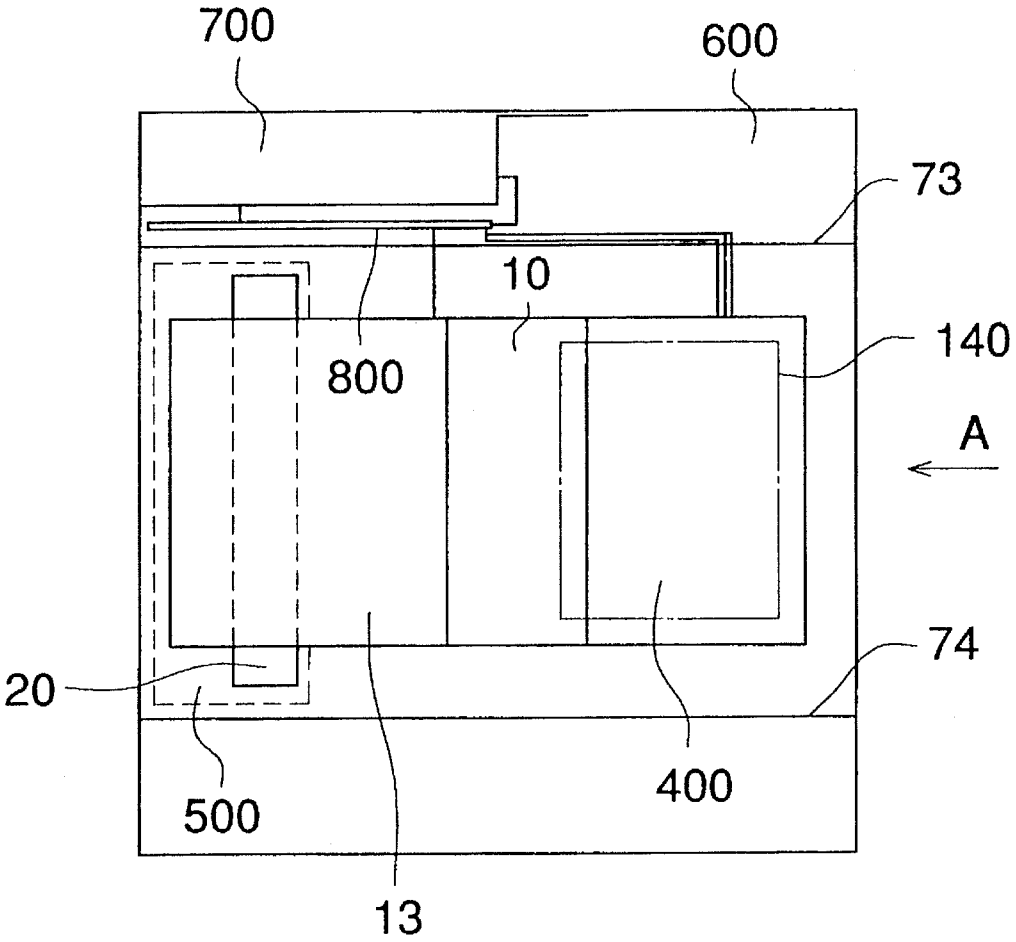
FIG. 2 is a plan view showing a layout of the color image forming apparatus.

FIG. 2 is a plan view of each unit, of which the above-described apparatus is composed, and shows a layout of each unit of the apparatus. In FIG. 2, the side indicated by an arrow corresponds to the front surface of the apparatus, that is, a side surface on an operation side.

The apparatus main body has two vertical side panels 73 and 74, between which a writing unit, which is the image exposure means 13, the photoreceptor drum 10, a developing unit 400 in which a plurality of developing devices 14 are housed, a fixing unit 20, and a DC power source unit 500 are incorporated. A driving system 600, a formatter 700 for decoding a printer command, a control circuit boards 800 for the sequence control of mechanical operations are housed on the outside of the side panel 73. Further, in the upper portion of the developing unit 400, a toner replenishing means 140, which is connected to each developing device 14 housed in the developing unit 400, is accommodated.

The photoreceptor drum 10, the charger 12 and the cleaning unit 22 are integrated and incorporated into a drum cartridge 30. The drum cartridge 30 is integrated and incorporated into a drum carriage 40, together with the developing unit 14, the toner replenishing means 140, the front panel 71 and the upper surface panel 72.

Figure 3:
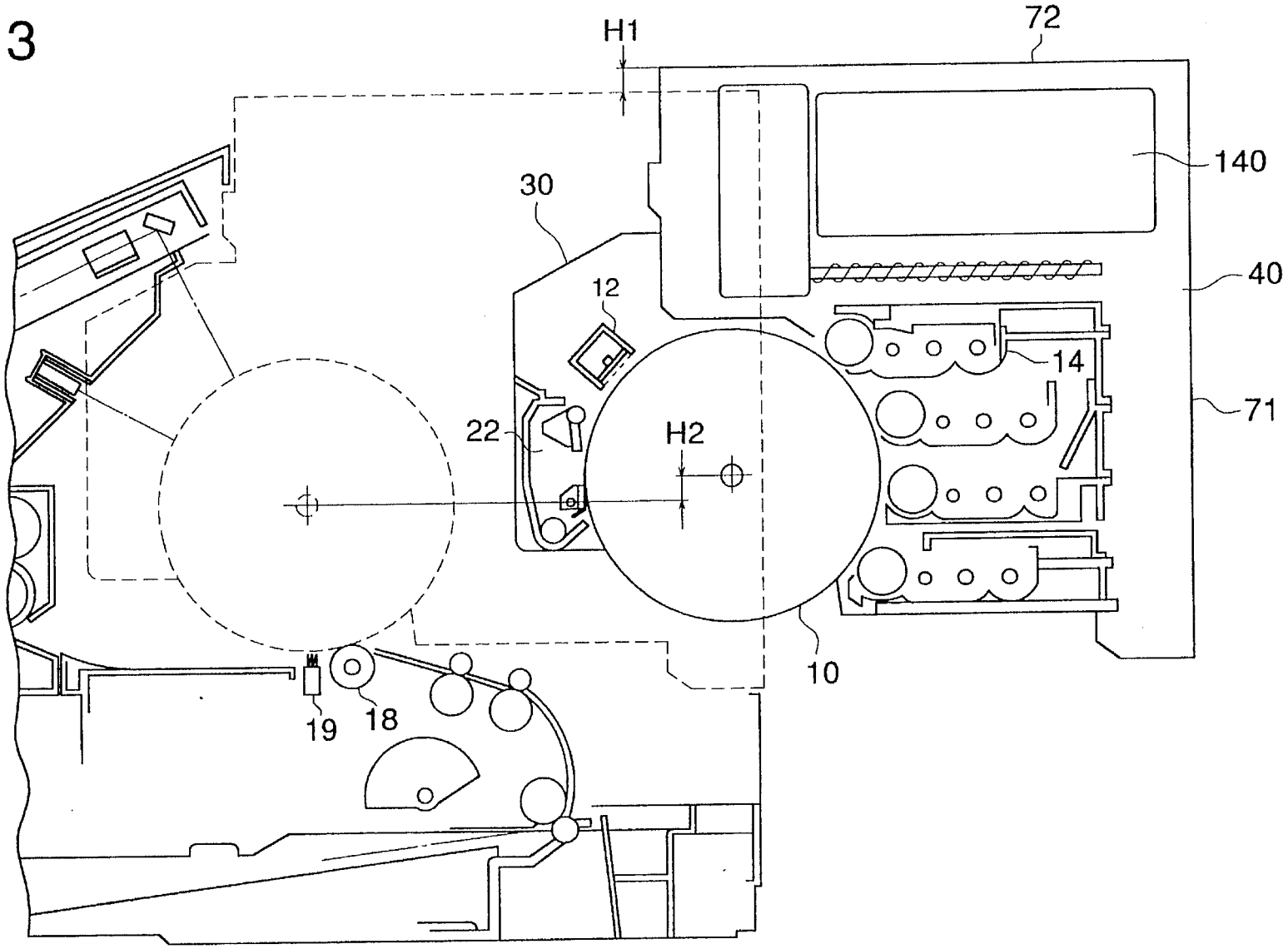
FIG. 3 is a sectional structural view showing a pull-out position of a drum carriage.

The drum carriage 40 can move horizontally from its installed position in the apparatus main body as shown by a broken line in FIG. 3, and can be positioned at its pull-out position. In this case, the drum cartridge 30 and the upper panel 72 follow the movement of the drum carriage 40, and are withdrawn from a position, at which an image can be formed, (shown by a broken line). Then, the conveyance path of the recording sheet P is fully exposed to the upper surface of the apparatus. Further, the transfer roller 18, the peak-electrode 19, the charger 12 and the cleaning unit 22, which are integrated and incorporated into the drum cartridge 30, are fully exposed to the upper surface of the apparatus.

Figure 4:
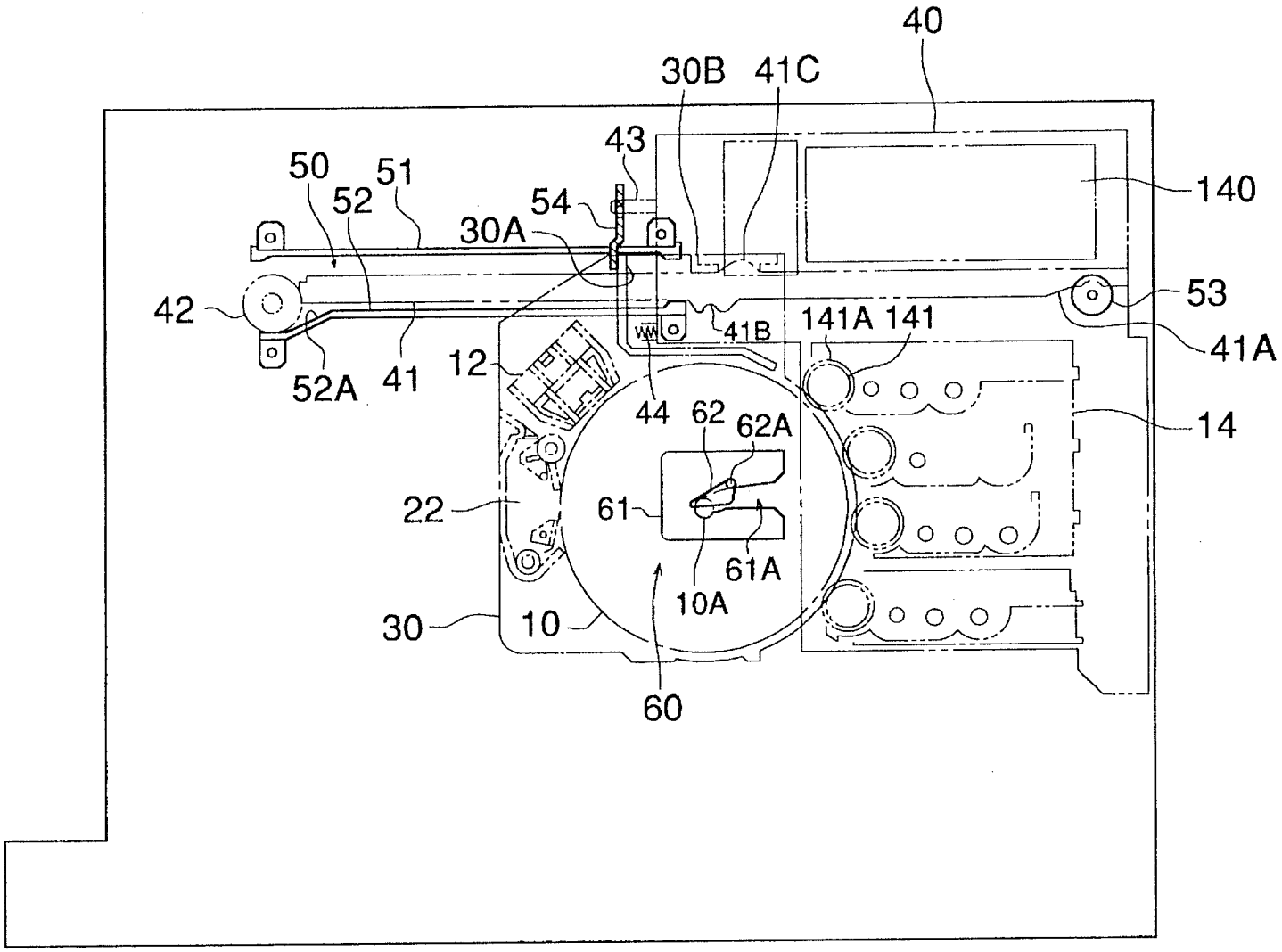
FIG. 4 is a sectional view of a primary portion, showing the structure when the drum carriage is installed.
Figure 5:
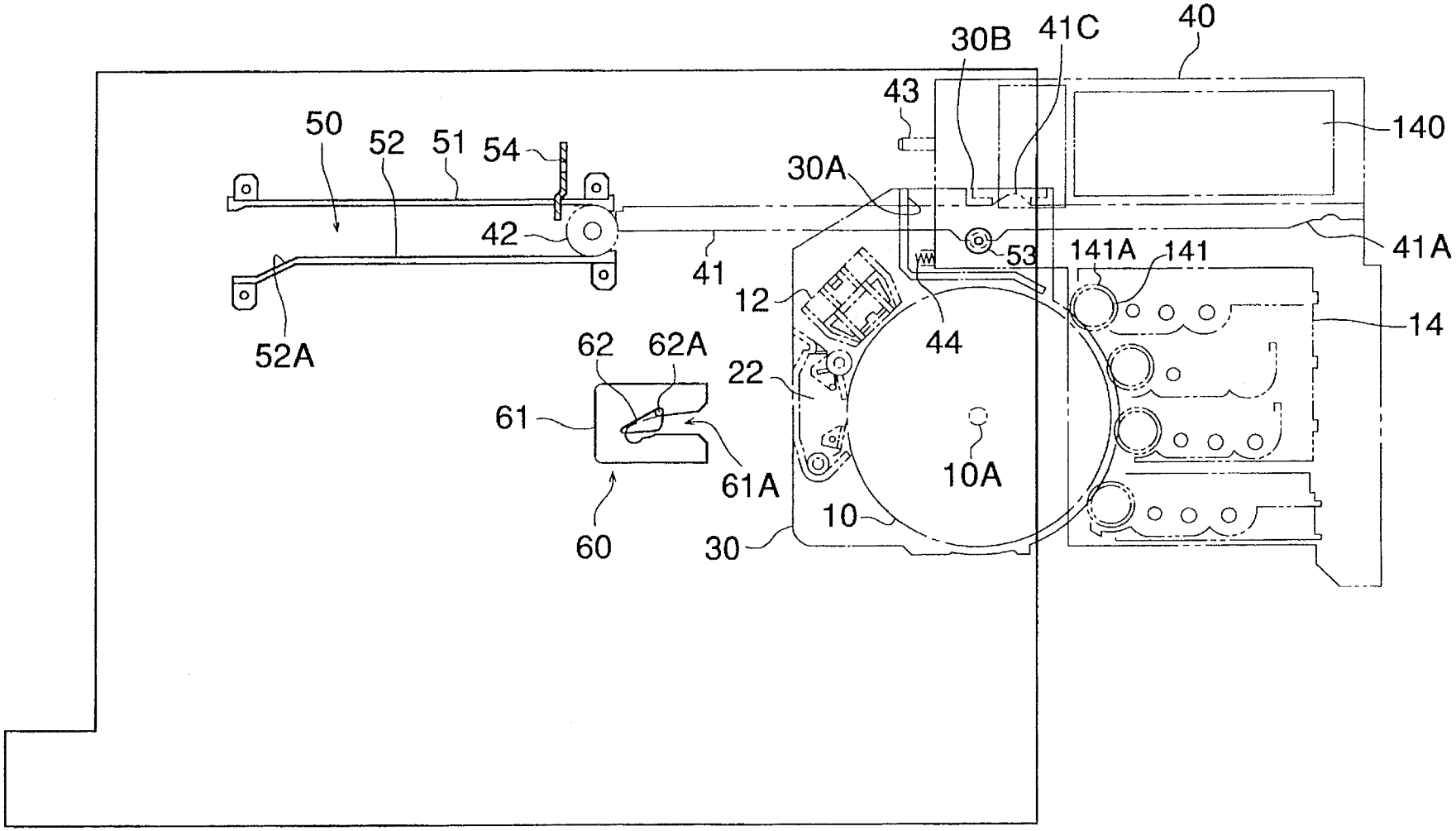
FIG. 5 is a sectional view of a primary portion, showing the structure when the drum carriage is pulled out.

In FIG. 4, the drum carriage 40 is located at its installed position, and the drum cartridge 30 is fixed to the image forming apparatus. In FIG. 5, the drum carriage 40 is moved to its pull-out position, and the drum cartridge 30 is withdrawn from the image formation position and is supported on the drum carriage 40 without being fixed to the drum carriage 40. For convenience's sake, the drum cartridge 30 side is shown by a one-dotted chain line, and the drum carriage 40 side is shown by a two-dotted chain line.

A first guide member 50, composed of an upper rail 51 and a lower rail 52, and a guide roller 53 are provided, facing each other, inside each of the side panels 73 and 74 in the apparatus main body.

The drum carriage 40 has a plate member 41 provided with a roller 42, on both side surfaces. The drum carriage is supported when the roller 42 is engaged with the guide member 50, and the plate member 41 itself is engaged with a guide roller 53.

In the installed position of the drum carriage 40, the drum carriage 40 is located at a position at which the roller 42 has moved to the end of an inclined surface 52A of the front end of the lower rail 52, by the weight of the drum carriage 40. When a cutout portion 41A provided at the rear end of the plate member 41 is engaged with the guide roller 53, the drum carriage 40 is vertically and horizontally positioned. Further, when a regulation pin 43 protruding from the front surface of the carriage 40 is engaged with a regulation hole on a collision plate 54 provided between the side panels, the vertical movement of the carriage is regulated.

A guide plate 61 provided with an opening portion 61A, and a second guide member 60 composed of an engagement lever 62 which is urged counterclockwise around a shaft 62A by an elastic member, which is not shown in the drawing, within a predetermined angle, are provided inside each of the two side panels 73 and 74, provided in the apparatus main body, such that the guide plate 61 and the second guide member 60 are opposed to each other.

Both ends of the drum shaft 10A, which rotatably supports the photoreceptor drum 10, protrude from the left and the right surfaces of the drum cartridge 30. At the installed position of the drum carriage 40, the position of the photoreceptor drum 10 is set when the drum shaft 10A is engaged with the opening portion 61A of the guide plate 61, and the engagement lever 62 comes into pressure contact with the drum shaft 10A.

When the position of the photoreceptor drum 10 is set, the left and right compression springs 44 provided on the front surface of the drum carriage 40 press a raised portion 30A of the drum cartridge 30 main body and press it onto the collision plate 54, and thereby, the drum cartridge 30 is set at the position at which an image can be formed.

Thus, collision rollers 141A of the urged developing units 14 are brought into pressure contact with the peripheral surface of the photoreceptor drum 10, which is positioned as described above, and a predetermined development gap is formed between the peripheral surface of the photoreceptor drum 10 and that of the developing sleeve 141. On the other hand, engagement of gears and electrical connections of electric contacts provided between the drum cartridge 30 side and the apparatus main body side are automatically conducted, and the supply of the motive power and electric power, and the control, which are necessary for image formation, can be conducted.

In the drum carriage 40, the roller 42 of the plate member 41 is moved inside the guide member 50, and when a lower edge of the cutout portion 41A slides onto the guide roller 53, the drum carriage 40 is pulled out toward the front of the apparatus main body, as shown in FIG. 5.

In the initial stage of movement in the pull-out operation of the drum carriage 40, the roller 42 rises along the inclined surface 52A of the lower rail 52. On the other hand, when the inclined surface of the cutout portion 41A runs on the guide roller 53, the regulation pin 43 is disengaged from the collision plate 54, while the drum carriage 40 is rising approximately horizontally to a predetermined height, and the drum carriage 40 is pulled forward. At the position at which the roller 42 is engaged with the edge portion of the guide member 50, an engagement portion 41B formed on the lower edge portion of the plate member 41 is simultaneously engaged with the guide roller 53, and the drum carriage 40 is stopped.

When the pull-out operation of the drum carriage 40 is started, each developing unit 14 is withdrawn from the range of the pressure-contact operation with respect to the photoreceptor drum 10. On the other hand, the drum cartridge 30 is released from the pressure, applied by the compression spring 44, and a receiving portion 30B, formed in an upper portion of the cartridge 30, is directly supported by the plate member 41 when the drum carriage 40 rises. When an upper protrusion 41C of the plate member 41 is engaged with the receiving portion 30B, the drum cartridge 30 is pulled out integrally with the drum carriage 40.

As a result, end portions of the drum shaft 10A protruding from the left and right side surfaces of the drum cartridge 30 are removed from the opening portion 61A of the guide plate 61 when the engagement lever 62 is forcibly rotated clockwise against the elasticity of the elastic member. The drum cartridge 30 is moved to its pull-out position, as shown in the drawing, without being fixed to the drum carriage 40, but being supported by the drum carriage 40. Thereby, the conveyance path of the recording sheet P is fully opened, resulting in easy maintenance operations such as jam clearance, replacement of parts or units, etc.

The above-described height H1 to which the drum carriage 40 rises at the start of its movement, is set such that the height H2, required for avoiding the frictional contact between the photoreceptor drum 10 and the transfer roller 18 by the rising motion of the photoreceptor drum 10 when the photoreceptor drum 10 is horizontally moved, is added to the height of a gap provided between the drum cartridge 30 and the drum carriage 40. Specifically, for example, when the height H2 is 5 mm, the height H1 is preferably set to not less than 6 mm.

When the drum carriage 40, at its pull-out position, is sufficiently forced from the front surface of the apparatus, shown in FIG. 5, the plate member 41 is disengaged from the guide roller 53, and slides horizontally. The drum carriage 40 is lowered by the height corresponding to the above-described height H1 at the final stage of its movement, and the plate member 41 is engaged again with the guide roller 53. Then, the drum carriage 40 is installed again at the position as shown in FIG. 4. As described above, the drum cartridge 40 can be stably installed in the apparatus main body by utilizing gravity.

On the other hand, the drum cartridge 30 slides horizontally, being driven by the movement of the drum carriage 40. The drum shaft 10A is lowered, being guided by the guide plate 61, in timed relationship with the lowering of the drum cartridge 40, and forcibly rotates the engagement lever 62. Thereby, the drum shaft 10A is fixed at the position shown in FIG. 4. Next, the drum cartridge 30 is set again to the image forming position by the pressure of the compression spring 44 of the drum carriage 40. The lowered amount of the drum carriage 40 corresponds to the above-described height H1. On the other hand, the lowered amount of the drum cartridge 30 corresponds to the above-described height H2. Accordingly, a gap is formed between the drum cartridge 30 and the drum carriage 40. Therefore, the drum cartridge 30 is not restrained by the drum carriage 40, and is set to a predetermined image forming position.

In the above-described examples, a drum-shaped image forming body is explained, however, a belt-like image forming body, in which a belt is provided between rollers, is also included in the present invention.

According to the present invention, a drum carriage, including an image forming body, a charging means, a developing means, and a cleaning means, is pulled out from the apparatus by relatively simple operations, so that the conveyance path for the recording sheet can be fully opened. As a result, jam clearance processing for the recording sheet can be easily carried out, and when the drum carriage is pulled out from the apparatus, the drum cartridge can be simply pulled out. Further, a transfer means, a separation means, and a charger and a cleaning unit accommodated in the drum cartridge, are fully exposed to the upper surface of the apparatus. Accordingly, maintenance, including cleaning operations and replacement operations for each means and device, and visual inspection, etc., can be easily conducted. Further, when the drum carriage and the drum cartridge are installed in the apparatus, the drum cartridge, the accuracy of which is required most in the relationship with an image exposure means, etc., is fixed to the apparatus main body under the condition that the drum cartridge is separated from the drum carriage, so that high accuracy can be maintained with respect to each device. Accordingly, an image forming apparatus is provided, in which a satisfactory image is constantly assured, and maintenance operations for each unit can be easily made, and which is also highly practical. Further, since a toner replenishment means, integrally provided in the drum carriage, is incorporated in the upper portion of each developing unit, the toner replenishment path can be simplified, and toner can be stably replenished.

What is claimed is:

1. An image forming apparatus comprising:

(a) a main body of the apparatus;

(b) an image forming body for forming an image thereon;

(c) a transfer unit provided on the main body for transferring a toner image formed on the image forming body onto a recording material and (d) a carriage movable between an installed position and a pull-out position in the main body, wherein the carriage supports the image forming body, and fixes the image forming body at a position where an image can be formed when the carriage is at the installed position, and wherein the carriage forms a part of an upper surface of the main body when the carriage is located at the installed position, and a portion over the transfer unit is opened when the carriage is located at the pull-out position, thereby the recording material is accessible through the opened portion over the transfer unit.

2. The apparatus of claim 1 further comprising a cartridge for accommodating the image forming body therein, wherein the carriage supports the image forming body through the cartridge.

3. The apparatus of claim 2, wherein the main body includes a first guide member along which the carriage is moved downward to be set to the installed position after the carriage is moved substantially in a horizontal direction from the pull-out position.

4. The apparatus of claim 3, wherein the main body further includes a second guide member, and after the carriage is moved toward the main body in the horizontal direction, the cartridge is moved downward along the second guide member to be set by engagement of a locking member to the position where the image can be formed.

5. The apparatus of claim 1, wherein the carriage comprises developing means for developing the image formed on the image forming body and toner replenishing means for replenishing toner to the developing means.

6. The apparatus of claim 5, wherein the toner replenishing means is provided over the developing means.

7. The apparatus of claim 1, wherein the carriage further comprises cleaning means for cleaning the image forming body.

8. The apparatus of claim 1, wherein the carriage comprises an integrated developing means having a plurality of developing units, thereby the plurality of developing units are detachably attachable to the carriage as a unit.

9. The apparatus of claim 1, wherein the main body includes a first guide member along which the carriage is moved downward to be set to the installed position after the carriage is moved substantially in a horizontal direction from the pull-out position.

* * * * *